US006202672B1

(12) United States Patent
Ellis et al.

(10) Patent No.: US 6,202,672 B1
(45) Date of Patent: Mar. 20, 2001

(54) VALVE ASSEMBLY

(75) Inventors: Craig D. Ellis; Kenith W. Chambers, both of Charleston, SC (US); Scott McCormick, Cincinnati, OH (US); Steven D. DeRidder, Bartlett; W. Layne Carruth, Cordova, both of TN (US); Stephen R. Schulte, Harrison, OH (US)

(73) Assignee: Hill-Rom, Inc., Batesville, IN (US)

( * ) Notice: Subject to any disclaimer, the term of this patent is extended or adjusted under 35 U.S.C. 154(b) by 0 days.

(21) Appl. No.: 09/093,303

(22) Filed: Jun. 9, 1998

Related U.S. Application Data

(60) Provisional application No. 60/056,763, filed on Aug. 25, 1997.

(51) Int. Cl.[7] ..... A47C 27/10

(52) U.S. Cl. ..... 137/223; 137/596.2; 251/129.15; 251/129.05; 5/713

(58) Field of Search ..... 5/710, 713; 137/596.2, 137/596.17, 223, 224, 884, 382, 377; 251/64, 129.05, 129.08, 121, 122, 129.15

(56) References Cited

U.S. PATENT DOCUMENTS

| | | | | |
|---|---|---|---|---|
| 1,825,526 | * | 9/1931 | Kamada | 137/596.17 X |
| 2,868,494 | * | 1/1959 | Kearns et al. | 251/64 |
| 3,446,473 | * | 5/1969 | Barker | 251/64 |
| 3,875,961 | * | 4/1975 | Gibbens | 137/223 |
| 4,000,756 | * | 1/1977 | Ule et al. | 137/596.17 |
| 4,369,696 | * | 1/1983 | Klatt et al. | 91/465 |
| 4,445,538 | * | 5/1984 | Bilski | 137/596.2 |
| 4,789,208 | * | 12/1988 | Kohno | 303/115.4 |
| 4,829,616 | * | 5/1989 | Walker | 5/713 |
| 4,892,285 | * | 1/1990 | Torrence | 251/129.15 X |
| 4,915,124 | * | 4/1990 | Sember, III | 137/223 |
| 4,945,590 | * | 8/1990 | Ogura | 5/713 |
| 4,949,757 | * | 8/1990 | Lashta | 137/884 |
| 5,090,076 | | 2/1992 | Guldager . | |
| 5,095,568 | * | 3/1992 | Thomas et al. | 5/713 |
| 5,182,826 | | 2/1993 | Thomas et al. . | |
| 5,193,574 | * | 3/1993 | Lopez | 137/382 |
| 5,272,778 | | 12/1993 | Gore . | |
| 5,349,983 | | 9/1994 | Ozarowski et al. . | |
| 5,367,726 | * | 11/1994 | Chaffee | 5/706 |
| 5,427,352 | * | 6/1995 | Brehm | 251/64 |
| 5,539,943 | | 7/1996 | Romano . | |
| 5,553,829 | * | 9/1996 | Hemsen | 251/64 X |
| 5,564,799 | * | 10/1996 | Fujimoto et al. | 303/119.2 |
| 5,570,716 | * | 11/1996 | Kamen et al. | 137/223 |
| 5,606,754 | | 3/1997 | Hand et al. . | |
| 5,647,079 | | 7/1997 | Hakamiun et al. . | |
| 5,715,548 | | 2/1998 | Weismiller et al. . | |
| 5,794,288 | | 8/1998 | Soltani et al. . | |
| 5,904,172 | * | 5/1999 | Gifft et al. | 137/224 |

FOREIGN PATENT DOCUMENTS

| | | |
|---|---|---|
| 0 260 087 | 3/1988 | (EP) . |
| 0 606 126 | 7/1994 | (EP) . |
| 7309831 | 1/1974 | (NL) . |
| WO 96/02760 | 2/1996 | (WO) . |

* cited by examiner

*Primary Examiner*—John Rivell
*Assistant Examiner*—Meredith H. Schoenfeld
(74) *Attorney, Agent, or Firm*—Bose McKinney & Evans LLP

(57) ABSTRACT

A valve assembly for an air mattress having a common actuator on a manifold between opposed supply and exhaust valves moving the valves along their actuating axis. The system includes a plurality of actuator/valve combinations for different portions of the air mattress. A pulsating valve is provided which includes a housing having therein supply and exhaust valves each directly controlled by supply and exhaust solenoids. The solenoids are of an improved design.

32 Claims, 8 Drawing Sheets

10
74
76
90
22
104
82
88
60
68
56
70
72
92
100
36
96
38
30
32
116
120
38
34
98
94
118
122
124
106
112
40
51
42
114
51
51
48
48
44
48
110
46
102
50
50
50
28
108
62
38
104
66
64
58
80
78

VALVE ASSEMBLY

CROSS-REFERENCE

This application claims the benefit of U.S. Provisional Application Ser. No. 06/056,763 filed Aug. 25, 1997 with respect to common subject matter and the application is incorporated by reference herein.

BACKGROUND AND SUMMARY OF THE INVENTION

The present invention relates generally to a control valve system for air mattress or air cushion support surfaces and more specifically to a control valve system for air mattresses or support surfaces having a plurality of individually controllable chambers, for example, hospital beds.

Other cushion pressure control designs, which use one valve to isolate the cushion from a manifold, with either pressure or vacuum then applied to the manifold, cannot simultaneously increase the inflation of one cushion while exhausting from another. This means that adjusting the cushions in response to patient movement or changes in bed position takes longer, resulting in reduced comfort and possibly a less effective therapy. Also, this type of design cannot be used for the most effective type of patient rotation systems, which increase the pressure in one rotation cushion while simultaneously decreasing the pressure in another.

Other designs may use multiple valves with independent actuators to achieve the desired control conditions. This requires control wiring and space for each actuator. Also this does not insures that only one of the valves per pair is actuated at one time.

Bed cushions are typically inflated to pressures between ½ psi and 1 psi. At these low pressures, the size of the flow opening in the valve must be relatively large in order to pass an adequate volume of air to inflate or deflate the cushion in a reasonable amount of time.

Existing valves which have large flow openings either have very large actuators, or are "pilot operated." A pilot operated valve uses a small actuator such as a solenoid to create a condition that causes a larger valve section to open. An example of this would be to use a solenoid to open a tiny valve which allows pressurized air to flow through into a chamber where it actuates a larger valve by pressing against a diaphragm. This type of pilot operated valve generally requires that the minimum air pressure be 3 psi or higher, in order to create enough force to actuate the larger valve. The types of pressurized air sources that are most desirable for hospital bed cushions (high flow low pressure blowers) do not generally create a high enough pressure to actuate a pilot operated valve unless the pilot device is very large.

Existing direct acting valves typically use electrical solenoids to operate a valve with a small opening. Since these valves are typically designed for higher pressures encountered in industrial and commercial applications, the valve openings are small.

The force acting against the operator for a direct acting valve is typically equal to the pressure the valve is sealing against multiplied by the cross sectional sealing area of the valve ($F=P\times A$). In an industrial valve, this force might be 100 psi; if a valve had a cross sectional sealing area of 0.20 inches (a practical area for the flows and pressures required by a hospital bed), the force to be overcome by the actuator would be 20 lbs. However, in a hospital bed, the pressure would be on the order of 1 psi, for a total force of only 0.2 lbs.

Because it is impractical to consider using a solenoid developing 20 lbs. of force due to the physical size and high electrical power consumption in high pressure industrial applications, these valves are generally designed with flow openings (valve orifices) having a cross sectional area of on the order of 0.01 square inches. This size opening is too small for the flow rates required at the lower pressures found in a hospital bed system.

Another limitation of prior art valve control structures is the ability to provide proportional flow control.

The valve seat and valve disk can be designed to be either flat, round or with varying amounts of taper. With a flat valve seat, a small amount of movement from the actuator causes a significant increase in flow through the valve. This type of seat and disk design is most useful when it is desirable to inflate a cushion as quickly as possible, or when it is desirable to create a pressure "pulse" with the sudden opening of the valve to high flow conditions.

As the amount of taper is increased on the valve seat and disk, a smaller change in flow is created for a given movement of the actuator. This makes it possible to control the rate of flow through the valve by controlling the positioning of the actuator. This characteristic is particularly useful in "low air loss" cushions, where air is continuously exiting the cushion through a fixed or variable size orifice. A valve with proportioning characteristics can be actuated to where it just provides sufficient air flow to balance against the loss of air from the cushion. As an alternative, the proportioning valve can be used on the discharge side of the cushion to create a variable size orifice to control the rate of discharge from the cushion.

Another use for the proportional flow control characteristics is to control rotation of the patient on the air cushion support surface. Studies have shown that a slow rotation created by simultaneously inflating one cushion while deflating another cushion is preferable to rapid rotation.

When an on/off type of valve is used to inflate or deflate a cushion, the delay time between sensing that the desired pressure has been reached and the time the valve is closed can cause "overshoot" that requires additional correction and adjustment.

A proportional valve can be opened to a full flow position initially to achieve a high rate of flow, then as the desired pressure is approached, the valve can be changed to a partial flow position to reduce or eliminate the overshoot condition as the pressure sensor and bed controls detect the desired pressure being approached.

Proportional opening of valves will result in smoother initial inflation, avoiding pressure peaks or shock waves that may cause patient discomfort. Controlled proportional opening and closing of valves can also reduce the mechanical and air flow noise caused by valves which suddenly open and close.

In controlling the surface pressures of a multiple zone, bed conditions often arise that make it desirable that some cushions receive a higher rate of air flow than others. This may occur because one cushion has a higher volume than others, because the patient weight shifts from one cushion or set of cushions to another, or because of an operating mode change in the bed (for example, by going into a patient rotation mode).

With on/off valves, this can only be achieved by turning the valves on and off at different rates. Such a method of operation can cause uneven inflation, pressure surges, additional noise and longer response times to achieve the desired cushion inflation rates.

In some circumstances, it is desirable to inflate some zones (e.g., side bolsters, head supports, and rotational cushions) to significantly higher pressures than other zones. This is often accomplished by increasing the pressure levels in the pressure supply manifold to serve the requirements of these "hyperinflated zones". With valve's having proportional control characteristics, it is possible to maintain accurate inflation control to the lower pressure zones by reducing the amount these valves open while the pressure manifold is in a hyperinflation state.

In other cases, the air supply may be limited for certain operational modes. For example, it may be desirable to inflate one or more cushion zones very quickly. If a less critical zone requires pressure at the same time, it may "rob" available air from the system, affecting the performance of the bed in meeting the requirements of the zone needing rapid inflation. Using a proportional valve allows the bed control system to restrict the opening of the less critical valves to allocate available air to the more critical locations.

This air apportioning capability can allow the use of small air sources, which require less electrical power, generate less noise and which occupy less space.

In the air cushion environment, an economic and effective actuator has not been found to proportionally position the valve. Solenoid control have been used for the on/off style control valves. Thus, the systems have not taken advantage of the tapered valve body and valve seat.

A control of an air mattress or cushion according to the present invention provides a unique proportional control valve. The system includes a manifold having at least a supply port, one exhaust port and one outlet port connected to a chamber in the manifold. A supply valve and an exhaust valve are on the manifold having coaxial actuating axes and connected to the supply and exhaust ports respectfully. A common actuator is on the manifold between the supply and exhaust valves so as to move the supply and exhaust valves along their actuating axes. The actuator is a linear actuator having first and second ends spaced from adjacent valve stems of the supply and exhaust valves in the neutral position of the actuator. The linear actuator preferably includes an electric motor. The actuator and valve stems are electrically isolated from each other and complete a circuit when engaged. This provides electrical feedback information. The valve bodies are molded from electrically insulated material.

The supply and exhaust valve each include a body having a first outlet connected to a respective port of the manifold, an inlet and a valve seat having an inlet and an outlet side. A valve element on the outlet side of the seat includes a stem extending therefrom through the valve seat to be engaged at its first by the actuator. A spring biases the valve onto the valve seat. The valve seat and the first outlet of the valve have generally an orthogonal axis. The valve body has a second outlet on the outlet side of the valve seat. The outlet port of the manifold is the second outlet of one of the valves. The second outlet of the other valve is plugged. The valve element and the valve seat include tapered portions. The valve element has a first tapered portion that defines a first rate of change of the size of valve opening and lower than the rate of change of a second tapered portion. The valve element includes a shoulder portion extending radially from the tapered portion. The valve seat has a cross-sectional area in the order of 0.10 to 0.40 square inches.

A second end of the actuator extending from the valve element is one of the seats of the spring. The first end of the actuator extends through and is guided by an aperture in the valve body. The second end of the aperture is received in a guide in the housing. The guide also forms a second stop for the spring. The guide on the housing is either in the outlet port or on the plug of the respective valve housing.

The manifold includes a first and a second portion joined together to form the chamber connecting the valve ports. The first portion includes a flange to which the actuator is mounted. The exhaust and supply valves are mounted to the first portion.

To control a plurality of air cushions, the manifold includes a plurality of chambers, each chamber having a supply and exhaust valve mounted to a supply and exhaust port for each of the chambers. The supply valves have a common supply plenum connected in its inlet. The supply valves and the supply plenum are formed as an integral structure. The exhaust valves also include an integral common supply plenum. The supply plenum may include a divider partitioning the plenum into two supply plenums. Electrical controls are mounted on the manifold and are connected to the actuators for each pair of valves. The electrical controls include a plurality of pressure sensors, each connected to a respective chamber. A pressure sensor is also connected to the supply plenum.

A unique pulsating valve is provided and is used in a system with the control valve for an air mattress with a plurality of bladders.

The pulsating valve includes a supply chamber, exhaust chamber and plenum in a housing. A supply valve and exhaust valve in the housing connect the supply and exhaust chambers respectively to the plenum. Supply and exhaust solenoids are connected to and control the supply and exhaust valves. The valves are in and the solenoids are mounted to an interior housing and are covered by an exterior housing. The exterior housing defines the chambers with the interior housing. The housing includes at least one supply port, one exhaust port and an outlet port and may include additionally a supply outlet.

The solenoids include a coil and a core in a casing and the valves are connected to a first end of the core through a first aperture in the casing. The casing includes a second aperture opposed a second end of the core. The core is substantially hollow along its length. A resilient stop is provided between the casing and the second end of the core to act as a shock absorber. A resilient element is placed between the solenoid and interior housing also to provide isolation and vibration absorption,. Vibration dampening mounts connect the housing to a support surface.

A valve assembly for an air mattress having a plurality of bladders includes a supply inlet, a first valve connected to the supply inlet and at least one outlet to be connected to a first bladder for pulsating air signals to the first bladder. A second valve is provided connected to the supply inlet and least one outlet is to be connected to a second bladder for inflating and deflating the second bladder. The first valve has a supply outlet and the second valve is connected to the supply outlet of the first valve. The second valve includes a linear actuator for positioning the valve and the first valve includes a solenoid for operating the valve. The first valve produces pulses in the range of 1–25 Hertz.

Other objects, advantages and novel features of the present invention will become apparent from the following detailed description of the invention when considered in conjunction with the accompanying drawings.

DETAILED DESCRIPTION OF THE PREFERRED EMBODIMENTS

Figure 1:
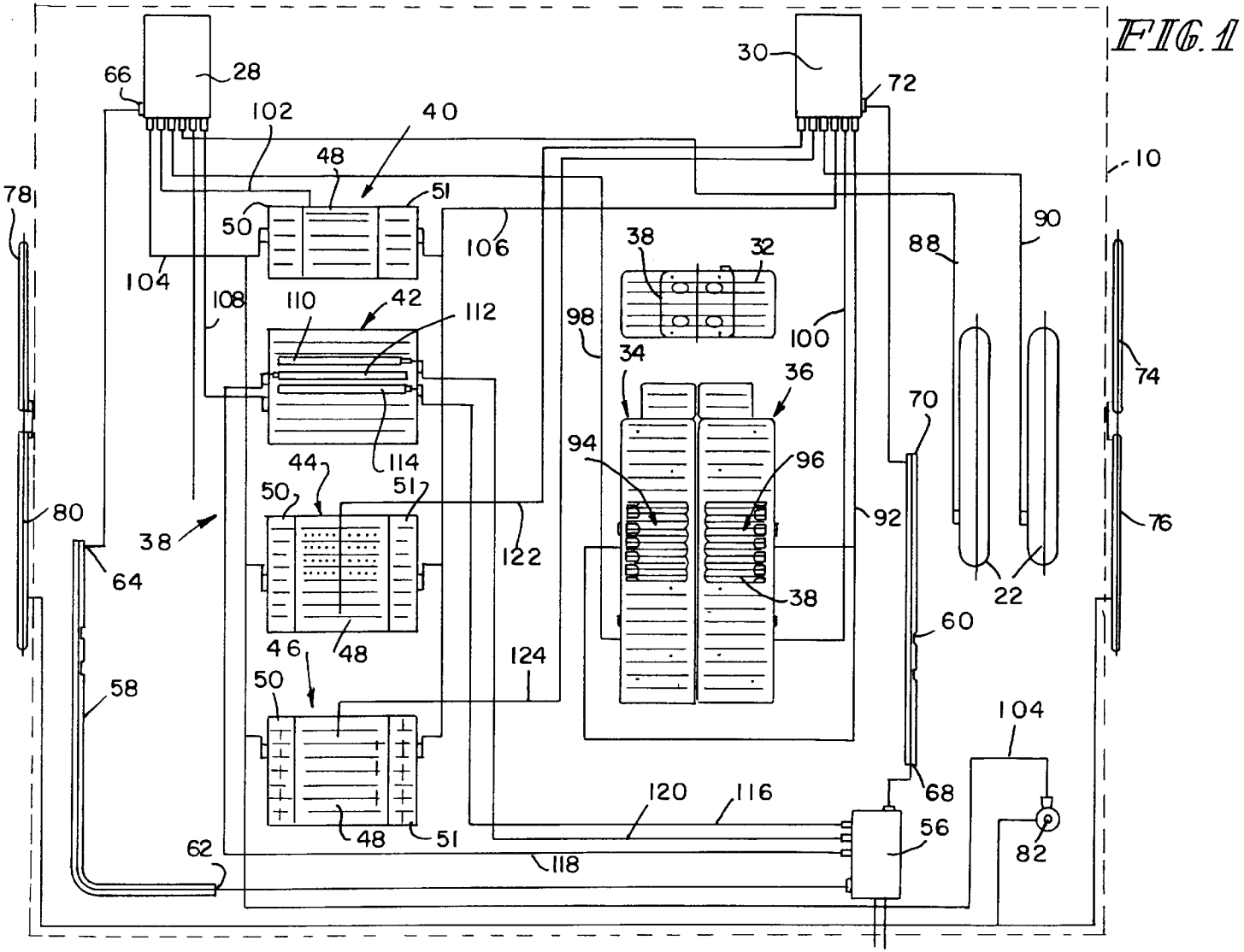
FIG. 1 is a schematic view of a multiple cushion mattress in which proportional and pulsing valves of the present invention can be used.

As illustrated in FIG. 1, a mattress assembly 10 in which the valves of the present invention are to be used is illustrated. A pair of rotational cushions 22 are located in the bottom and run the longitudinal axis of the mattress assembly 10. The rotation cushions 22 are selectively inflated and deflated to control the rotation therapy of a patient located on the mattress. A pair of identical proportional valves 28 and 30 are provided in the mattress and are to be discussed with respect to FIGS. 2–4. The lower cushion structure includes a lower head cushion 32 and lower body cushions 34 and 36. Support surface bladder 38 are located on top of the cushions 32, 34 and 36 and includes a head cushion 40, a chest cushion 42, a seat cushion 44 and a foot cushion 46. Support cushions 40, 44 and 46 include an inner bladder section 48 and another bladder section 50 and 51 which are controllable from an air supply source. Air enters the mattress assembly 10 from a blower through inlet 54 coupled to a pulsating or a percussion/vibration valve 56 to be discussed in detail with respect to FIGS. 5–9. The air supply inlet 54 is also coupled to proportional valves 28 and 30 via hoses 58 and 60 respectively. Alternatively, a T-fitting could be used.

The mattress assembly further includes width extension cushions 74, 76, 78 and 80 which are positioned outside the exterior of the mattress walls. The extension cushion 74, 76, 78 and 80 are coupled together and to a select valve 82 which selectively connects the extension cushions to exhaust or via hose 104 to the proportional control valve 28. The rotational bladders 22 are coupled to valves 28 and 30 by lines 88 and 90. The lower body cushions 34 and 36 include internal bladders 94 and 96 respectively, which are each coupled to a supply line 92 of the valve 30. The external bladders cushion 34 and 36 are coupled to outlets of valves 28 and 30 via lines 98 and 100 respectively.

The central section 48 of the head support cushion 90 is coupled to an outlet of valve 28 by line 102. Opposite sections 50 and 51 of the head support surface cushions are coupled to valves 28 and 30 by lines 104 and 106 respectively. The chest support surface cushion 42 is coupled to valve 28 by line 108. The chest support surface cushion includes internal bladders 110, 112 and 114. Bladder 110 is coupled to a first outlet of the pulsating valve 56 by line 116, bladder 112 is coupled to valve 156 by line 118 and bladder 114 is coupled to valve 56 via line 120.

Side portions 50 and 51 of the seat support section 44 are coupled to valves 28 and 30 via lines 104 and 106 respectively. The central portion of the seat support cushion 44 is coupled to valve 30 by line 122. Opposite side sections 50 and 51 of the foot support cushions 46 are coupled by supply lines 104 and 106 to valves 28 and 30 respectively. The central section 48 of the foot support cushion 46 is coupled to the valve 30 by supply line 124.

Further details of the mattress 110 are disclosed in U.S. application Ser. No. 08/917,145, entitled "Mattress Assembly" filed concurrently herewith, the disclosure of which is incorporated herein by reference. This mattress structure is but one of many structures of which the improved valves of the present invention are used. The valves to be described may be used with other cushions or air mattress structures.

Details of the proportional valves 28 and 30 will be described with respect to FIGS. 2, 3 and 4. The proportional valve includes a manifold 200 having a first manifold portion 202 and a second manifold portion 204 joined together by fasteners 206 through matching openings 208. A gasket (not shown) is positioned between the first and second manifold portions. The first manifold portion 202 includes a flange 210 having actuator apertures 212. The first manifold portion 202 also includes a plurality of apertures 214 for the supply valves, 216 for the exhaust valves and 218 for pressure sensor of the individual manifold chambers.

The second manifold portion 204 has a plurality of chambers 222 which align with the supply and exhaust apertures 214 and 216 of the first manifold section 202. A sensing area 224 aligns with apertures 218 for pressure sensor nipple 220. The actuators 226 are mounted in actuator aperture 212 of flange 210 of the first manifold portion 202 by fasteners 228 through aligned openings 230 on mounting bracket 232 and flange 210.

The actuator 226 is a linear actuator having a pair of opposite extending arms 234 and 236. Preferably, the actuator 226 is a stepper motor turning a threaded bushing that causes a threaded shaft to move either of two directions, depending upon the rotational direction of the motor. Preferably, the shaft includes arms 234 and 236 which include splines to prevent rotation of the threadable shaft. The stepper motor is designed to provide precise control of the amount of rotation and can be rotated in increments of one step or microsteps. The rate of stepping or the number of steps can be controlled by motor drive controls. This control of the rating stepping and the number of stepping provides precise control of the movement of the valve actuator arms 234 and 236 to provide the precise control of the valve and therefore the air flow control. The movement of the actuator is linear in the order of 0.001 inch per step on the motor, for example. Servomotors or other electrical or pneumatic motors in a closed loop system with pressure sensors could be used.

The stepper motor of the linear actuator 226 uses a gear ratio affect to multiply the actuation force supplied to the valves relative to the amount of power applied to the drive motor. Thus, an actuator 26 with a power consumption of 3–5 watts can be used instead of a solenoid or other actuators with power of consumptions of 10–30 watts. With the six pairs of valve structure illustrated in FIGS. 3 and 4, this is a considerable savings in power. An example of a stepper motor is Model Z26561-12-004 from Haydon Switch and Instrument, Inc.

The gear ratio on the actuators also provide a mechanical lock for the actuator at a fixed position if power is removed from the actuator. The gears oppose and resist movement from a restoring spring of the valves to be discussed.

Supply valves 238 and exhaust valves 240 are also mounted to the first manifold portion 202. The supply valves 238 and the exhaust valves 240 are identical except for the areas to be noted. They each include a plenum 242. The supply element 242 includes at one end a supply connector 244 which is connected to a source and a plug 246 at the other end. For the exhaust valve 240, both ends of the plenum 242 may be opened or one end selectively plugged. It should also be noted that the plenum 242 may be divided into two plenums by providing a partition in the plenum and include a supply connector 244 at each end of the plenum.

Also, connected to each of the plenums 242 are a plurality of valve bodies 248. Six valve bodies are illustrated. The plenum 242 and the valve bodies 248 are formed as a single piece and preferably are a molded piece of electrically insulated material. The supply valves 238, the exhaust valves 240 and the plenums 242 are mounted to the first manifold portion 202 by a plurality of hold downs 250 by fastener 252. Hold downs 250 have radius surfaces 254 to engage adjacent surfaces of the valve bodies 248. In the preferred embodiment, three hold downs 250 are used for each of the integral valve/plenum structure, each engaging a pair of valve bodies 248. Less or more than three may be used. It should be noted that the hold downs 250 are not shown in FIGS. 3 and 4.

Figure 4A:
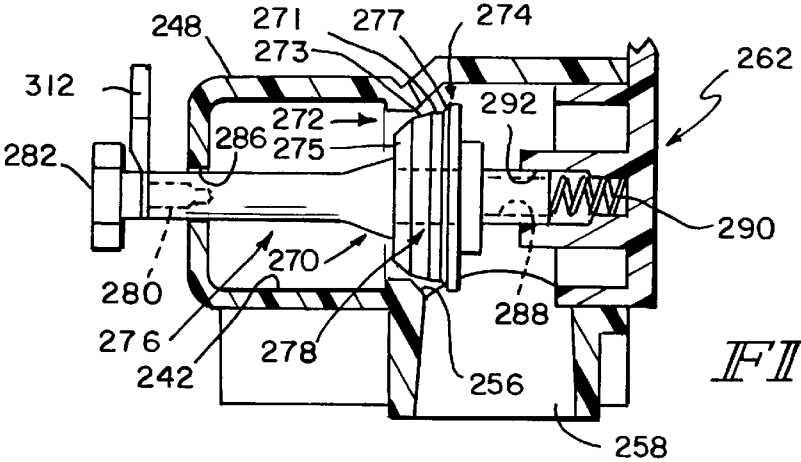
FIG. 4A is a cut-away of valve and manifold of FIG. 4.
Figure 4:
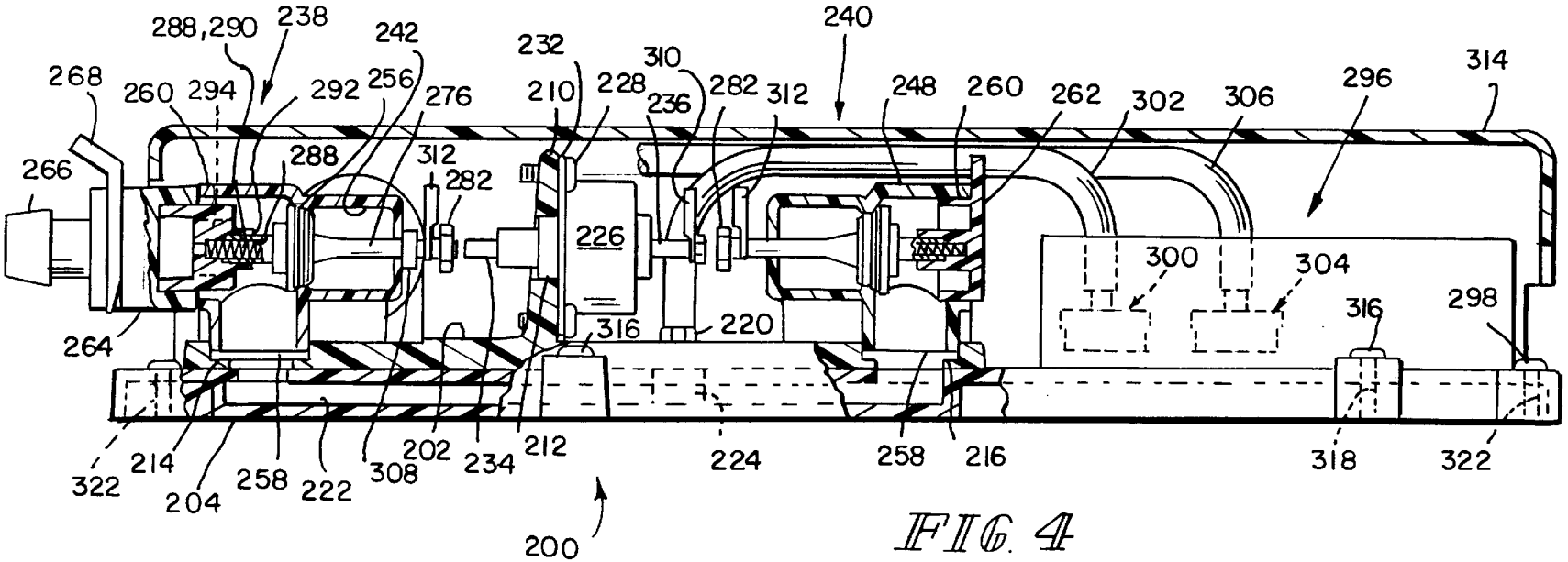
FIG. 4 is a side cut-away view of the assembled proportion valve of FIG. 3.

Referring to FIGS. 4 and 4A, the valve body 248 has a valve seat 256 which is connected to the inlet or plenum 244 on one side and connected to a pair of outlets 258 and 260 on the other side. The outlet 258 is received in and connected to apertures 214 and 216 of the first manifold portion 202 and thereby connecting the other side of the valve seat to chamber 222. The second outlet 260 of the exhaust valve is blocked by a plug 262. The second outlet 260 of the supply valve includes an outlet connector 264. A hose connector 266 is secured to the outlet connector 264 by a staple 268 and to form thereby a quick disconnect. Although the supply valve's second outlet 260 is shown as the output of the manifold, alternatively the exhaust valve's second outlet 260 may be the output of the manifold in chamber 222.

The cross sectional area of the valve seat 256 is in the order of 0.20 square inches and may be in the range of 0.01 to 0.04 square inches. This cross section provides the appropriate high flow volume at low pressure drops across the valve. Typical air flow is in the range of 5 to 45 cubic feet per minute with pressure drops of 5 to 6 inches of water column.

The valves further include a valve element 270 to be received on valve seat 256. As shown in FIG. 4A, the valve element 270 includes a tapered portion 272 and a shoulder portion 274 extending radially from the tapered portion 272. The tapered portion 272 includes a first taper 271, a second greater taper 273 and a third taper 275 greater than the second taper 273. As the valve opens, the different tapers provide different rates of change of the size of the valve opening. By way of example only, the first taper is substantially zero for an axis distance of 0.015 inches and has a diameter smaller than the diameter of the valve seat. The second taper 273 is at 11° for an axial length of 0.044 inches. The third taper 275 is 45° for an axial length of 0.038 inches. The shoulder 274 includes a taper 277 to make a more conformal sealing against the valve seat 256 when the valve is closed. For example, the taper 277 is at 50°. The taper angle of the valve seat 256 is greater than the tapered angle of the tapered portion 272 of the valve element. This allows the valve element to seat and seal better with less opportunity to stick to the seat.

The valve element 270 is mounted to a valve stem 276 in a recess 278. A threaded bore 280 in a first end of the stem 276 receives a threaded portion of a tip 282. One side of the valve stem 276 extends through the valve seat 256 and the plenum 242 and through an aperture 286 in the wall of the plenum 242. The tip 282 is then screwed into the threaded port 280. The aperture 286 acts as a guide and support for the one side of the stem 276. The opening 286 is a few thousands of an inch larger in diameter than the valve shaft 276. Since the plenum 242 is not connected to the outlet for the bed cushions when the valve is closed, it is not essential that the opening 286 be air tight. If more capacity is needed, opening 286 may be sealed.

When both the supply valve 238 and the exhaust valve 240 are closed, and the actuator 226 is in its neutral position, the ends of the arms 234 and 236 of the actuator are evenly spaced from the tips 282 of the valve the stems 276. The actuator 226 rotates in one or the other direction to extend one of the arms 234, 236 to engage the tips 282 of the valve stem 276 in opening 284 to open the respective valve.

Thus, in effect, the electrical actuator 226 in combination with location of the spring closed valves produces the effect of a three way valve with a lap position. It does it without any pilot pressure and merely the use of springs and electrical mechanical actuator.

The other end of the valve stem 276 includes a bore 288 to receive and be a stop for one end of a spring 290. The plug 262 and the outlet connector 264 in the outlet 260 of the valve housing includes a bore 292 in a cylindrical section which receives the other end of the spring 290 and the end of the actuator 276. The end of valve stem 276 rests in bore 292 for its total length of travel between its open and closed position. On the connector 264, the cylindrical portion with bore 292 is suspended in the outlet 260 by support vanes 294. The bore 292, by receiving the other end of the valve stem 276, provides a guide and support for the other end. Thus, the valve stem 276 is guided and supported on both of its ends. This improves the stability and alignment of the valve element 270 on the seat 256.

As can be seen from FIG. 4, the valve seat 256 is coaxial with the outlet 260 and generally orthogonal to the outlet 258 which connects to the chamber 222. It should also be noted that the actuator or valve stem 276 of the supply and exhaust valves are coaxial so to be easily operated by a single actuator 226. If the outlet 260 were placed orthogonal to the valve seat 256, a separate support structure for the other end of the actuator 276 would have to be provided. If the outlet 258 to chamber 220 was coaxial to the valve seat 256, it would include the appropriate guide 292.

The spring 290 provides force needed to close the valve and to press the valve element 270 on the valve seat 256 against any air leakage when the valve is closed. The location of the valve element on the outlet side of the valve seat allows any additional pressure placed on the cushion or mattress and being fed back to the inlet 260 to apply further pressure on the valve and maintain them closed. It also allows the use of a vacuum instead of an exhaust on the plenum 242 of the exhaust 240. This will also further increase the closure of the valve.

The electrical control portion 296 is in a housing and secured to the second manifold portion 204 by fasteners 298. The electrical controls include the appropriate electronics to operate the actuator based on commands and feedback or measured signals. The electronic control 296 includes a plurality of pressure sensors 300 connected by a hose 302 to the nipple 220, one for each of the chambers 222. An additional pressure sensor 304 to monitor the supply is connected by a hose 306 to nipple 308 in the supply plenum 242.

Preferably, the valve shaft 276 is made of metal and the valve housing and plenum is made of a molded dimensionally stable thermoplastic, for example, glass filled nylon. To determine when one of the arms 234, 236 of the actuator engages one of the valve stems 276, electrical slide connections 310 and 312 are mounted to, for example, the metal arm 236 of the actuator and the metal valve stems 276 as illustrated in FIG. 4 for the exhaust valve 240. Since the valve housing and plenum are made of electrically insulate material, the arms 234 and 236 are electrically isolated from the valve stems 276. The connection completes a circuit in the control electronics 296.

By monitoring these connections, the control electronics 296 can determine just when the valve actuator arms touch the valve shaft 276 to begin to open the valves. The controls can then use this information to establish a zero positioning for opening the valve element 270. By counting pulses or steps into the stepper motor from this point forward, the controller can estimate the valve disposition and the orifice opening with great precision. With knowledge of the taper, the valve and the seat relative axial position, control and regulation may be performed. If space or cost is not a factor, additional encoders can be provided to the stepper motor and provide closed loop positioning control.

A cover 314 is secured to the second manifold portion 204 by fasteners 316 through aligned openings 318. Fasteners 320 provided through openings 322 secure the manifold and all of the elements mounted thereto to a mattress or other support structure. The cross sectional area of the valve seat 256 is in the order of 0.20 square inches and preferably in the range of 0.10 to 0.40 square inches.

Figure 2:
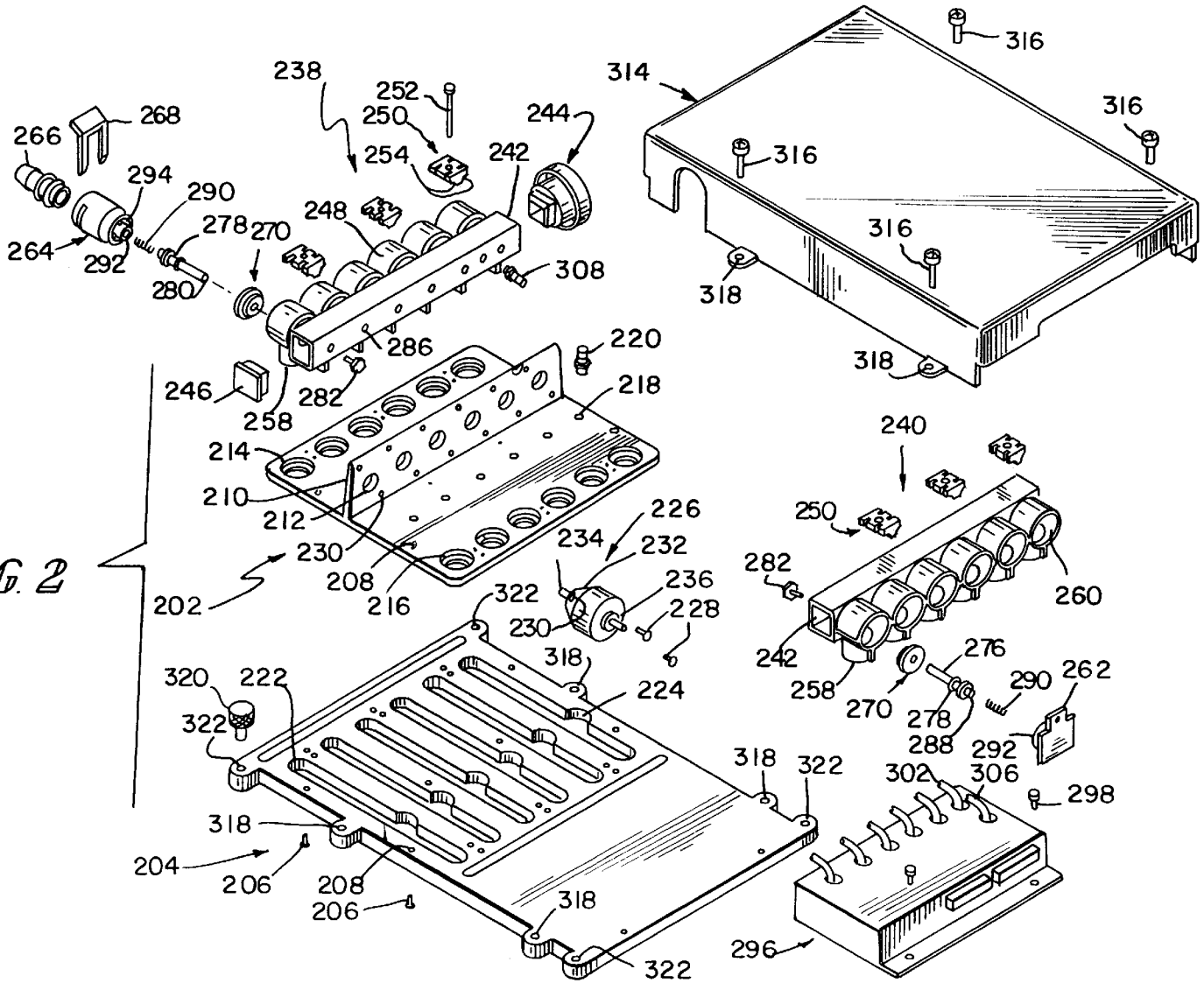
FIG. 2 is an exploded view of a proportional valve incorporating the principles of the present invention.
Figure 3:
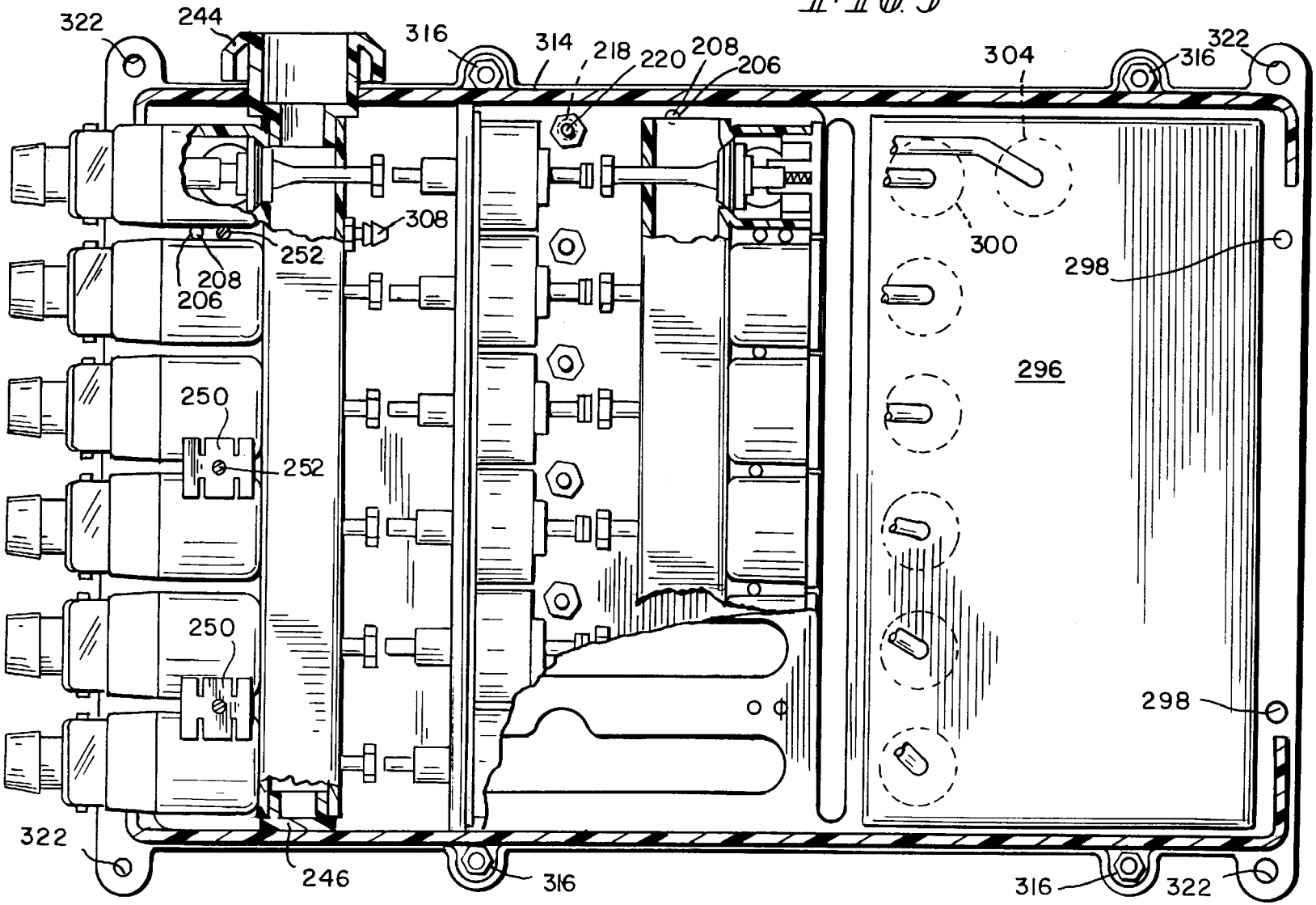
FIG. 3 is a top cut-away view of the assembled proportional valve of FIG. 2 according to the principles of the present invention.

Although the schematic FIG. 2 has shown the valves 20 and 30 as part of the mattress, they may be separate and the connections may be made to the mattress.

Figure 5:
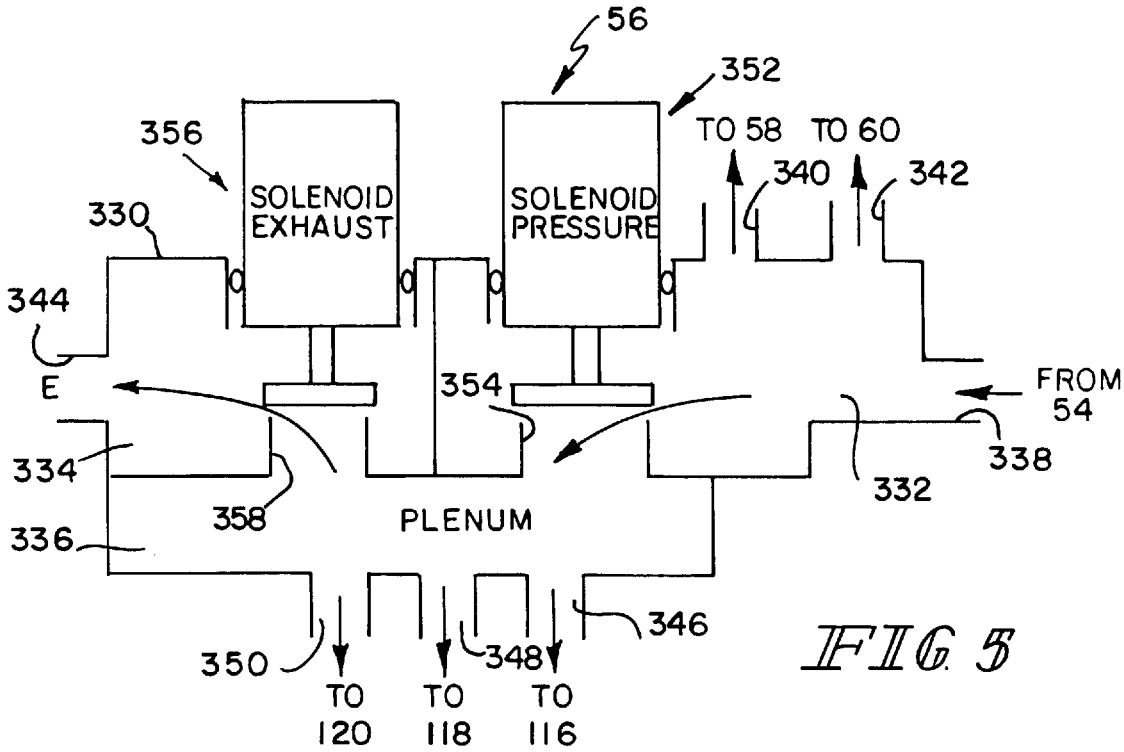
FIG. 5 is a schematic of a pulsating valve according to the principles of the present invention.
Figure 8:
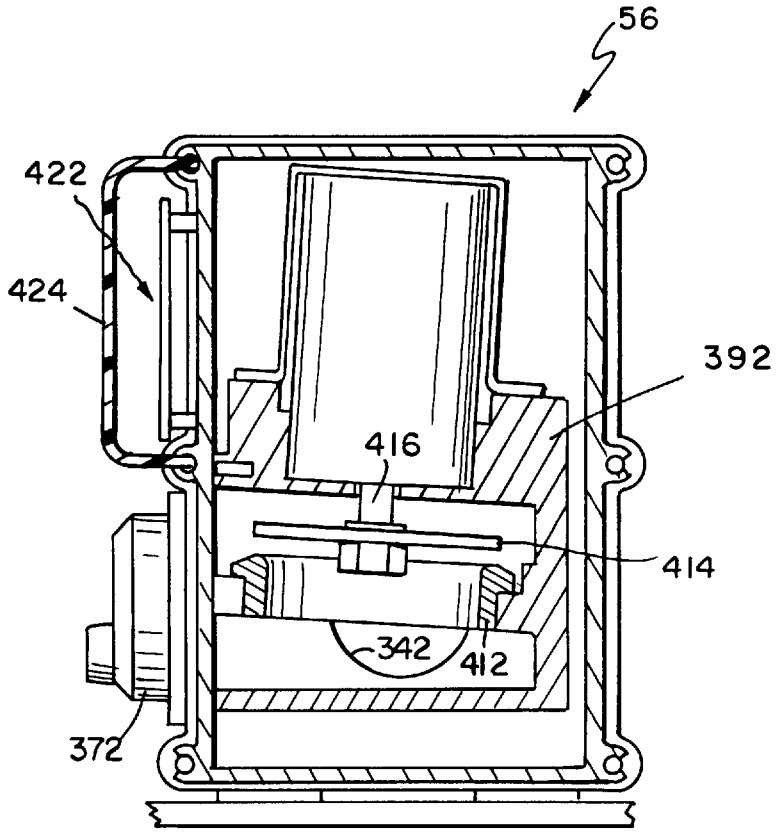
FIG. 8 is an end cut-away view of the pulsating valve of FIG. 7.

A schematic for the pulsating valve 56 is illustrated in FIG. 5. The valve housing 330 has a supply chamber 332, an exhaust chamber 334 and a plenum 336. The supply chamber 332 has an inlet 338 receiving pressure from connection 54 and a pair of outlets 340 and 342 connected to hoses 58 and 60. The pressurized air flow from inlet 338 flows directly to the outlets 340 and 342 and is not controlled by the valve. This particular structure is for the unique mattress configuration. If the pulsating valve 56 is not used as the single connection to the exterior source or supply of pressurized air for a system, outlet ports 340 and 342 either may be eliminated or plugged. The exhaust chamber 334 is connected to atmosphere via exhaust port 344. The plenum 336 includes outputs 346, 348 and 350 connected to lines 116, 118 and 120 respectively.

A supply valve or solenoid 352 controls the opening of the port 354 connecting the supply chamber 332 to the plenum 336. An exhaust valve or solenoid 356 controls the connection of the plenum 336 to the exhaust chamber 334 through port 358. The ports 354 and 358 have an opening in the range of 0.20 to 0.50 square inches for the low operating pressures, for example, in the range of 1 to 2 PSIG. The large opening allows use of larger solenoids. The valve structure and solenoids are capable of being operated to produce a percussion pulse in the range of 1–5 Hertz and a vibration pulse in the range of 6–25 Hertz. The electrical controller alternates energization of the supply solenoid 352 and the exhaust solenoid 356 to produce the air pressure pulses or impulses.

Figure 6:
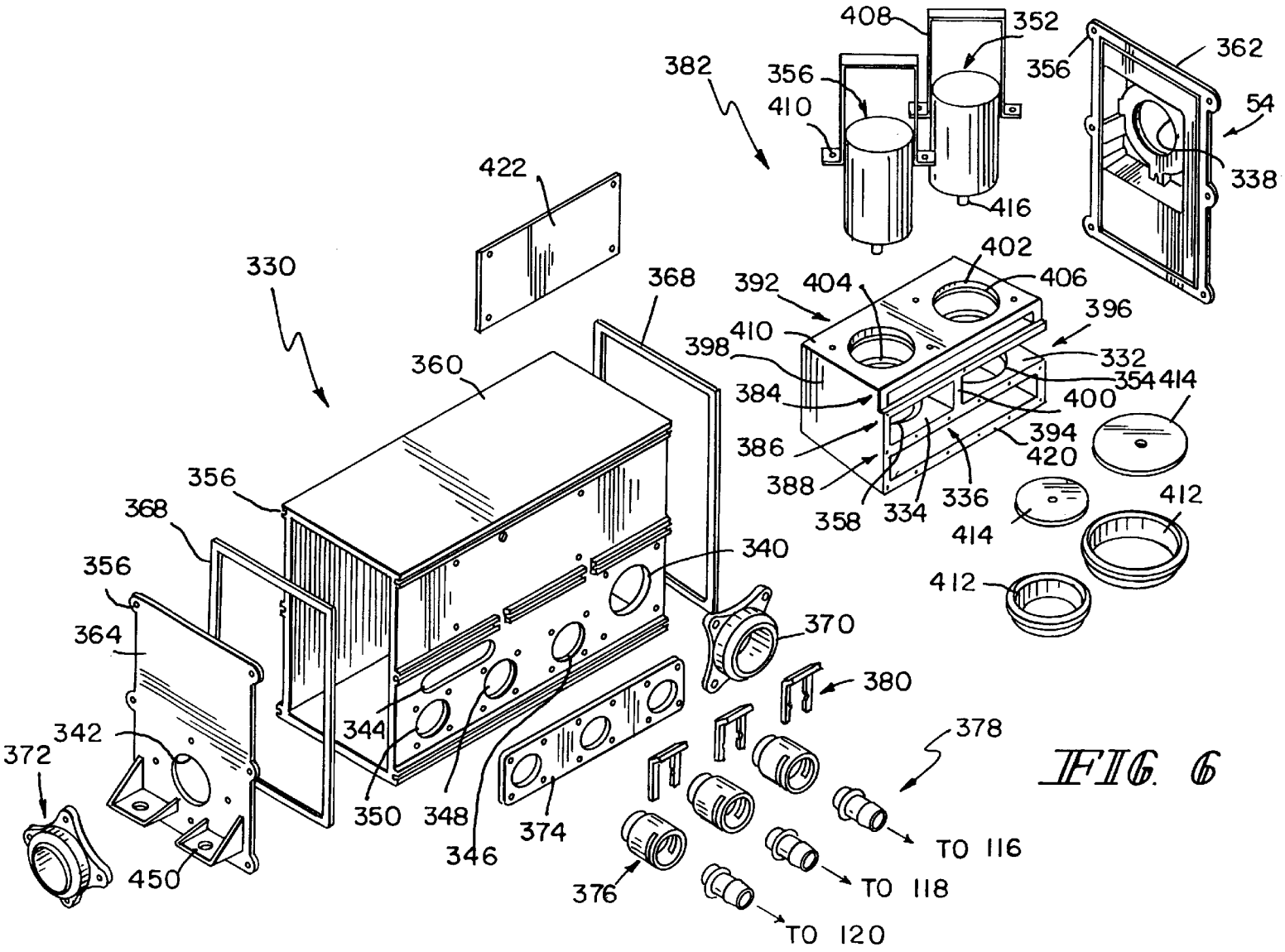
FIG. 6 is an exploded view of a pulsating valve according to the principles of the present invention.

Referring specifically to FIG. 6, the housing 330 incudes an exterior housing 360 having a pair of end walls 362 and 364 screwed thereto by fasteners (not shown) through aligned opening 356. Each end walls 362 and 364 includes a gasket 368. A connector 370 is provided in supply outlet 340 and a connector 372 is provided in outlet 342 in an end wall 364. They are secured by fasteners not shown. A mounting plate 374 connects outlet connectors 376 in the outlet ports 346, 348 and 350 in the side wall of the housing 360. The connectors 376 in combination with hose connectors 378 and staples 380 form a quick disconnect.

An interior housing 382 includes a top wall 384, a first intermediate wall 386, a second intermediate wall 388, and a bottom wall 390. It also includes a solid back wall 392, a front face 394 having an opening area, a first side wall 396 having an opening area and a solid side wall 398. Interior wall 400 between intermediate walls 386 and 388 define the supply chamber 332 and exhaust chamber 334. The second intermediate wall 388 and the bottom wall 390 define the plenum 336. Apertures 404 in the first intermediate wall 386 and apertures 402 in the top wall 384 receive the body of the solenoid valves 352 and 356. An O-ring 406 positions the body of the solenoids 352 and 356 in a recess or shoulder in aperture 402 in the top wall 384 and provides vibration isolation and maintains equal radial distance of solenoid to housing. Other noise reduction measures include a soft rubber, fabric or leather disc between the face of solenoids 352 and 356 and the solenoid mounting surface adjacent openings 404 in intermediate wall 386. A strap 408 secures each of the solenoids 352 and 356 to the interior housing 82 by fasteners (not shown) through aligned fastener opening 410. Valve seats 412 are provided in ports 354 and 358 in the intermediate wall 388 and mate with valve elements 414 mounted to plungers 416 of the solenoid valves 352 and 356 by fastener 418.

The interior housing 382 with the solenoid valves 352 and 356 mounted thereon are slid into the exterior housing 360 with a gasket 420 on a portion of the front face 394 and secured thereto by the fasteners which secure the mounting plate 374 as well as three additional fasteners. This aligns the plenum 336 adjacent the outlets 346, 348 and 350. It also aligns the exhaust port 344 with respect to the exhaust chamber 334. Since the interior housing 382 does not extend the full length of the exterior housing 360, the area between the interior housing and exterior housing forms a continuation of the supply chamber 332 and connects the supply inlet 338 to the supply outlets 340 and 342.

Preferably, the interior housing 382 is a cast aluminum block to operate as a heat sink for the solenoids 352 and 356. Also, the valve seats 412 are preferably rubber while the valve elements 414 are also aluminum. Driver card 422 is mounted to the exterior housing 360 and covered by cover plate 424 shown in FIG. 8.

Figure 9:
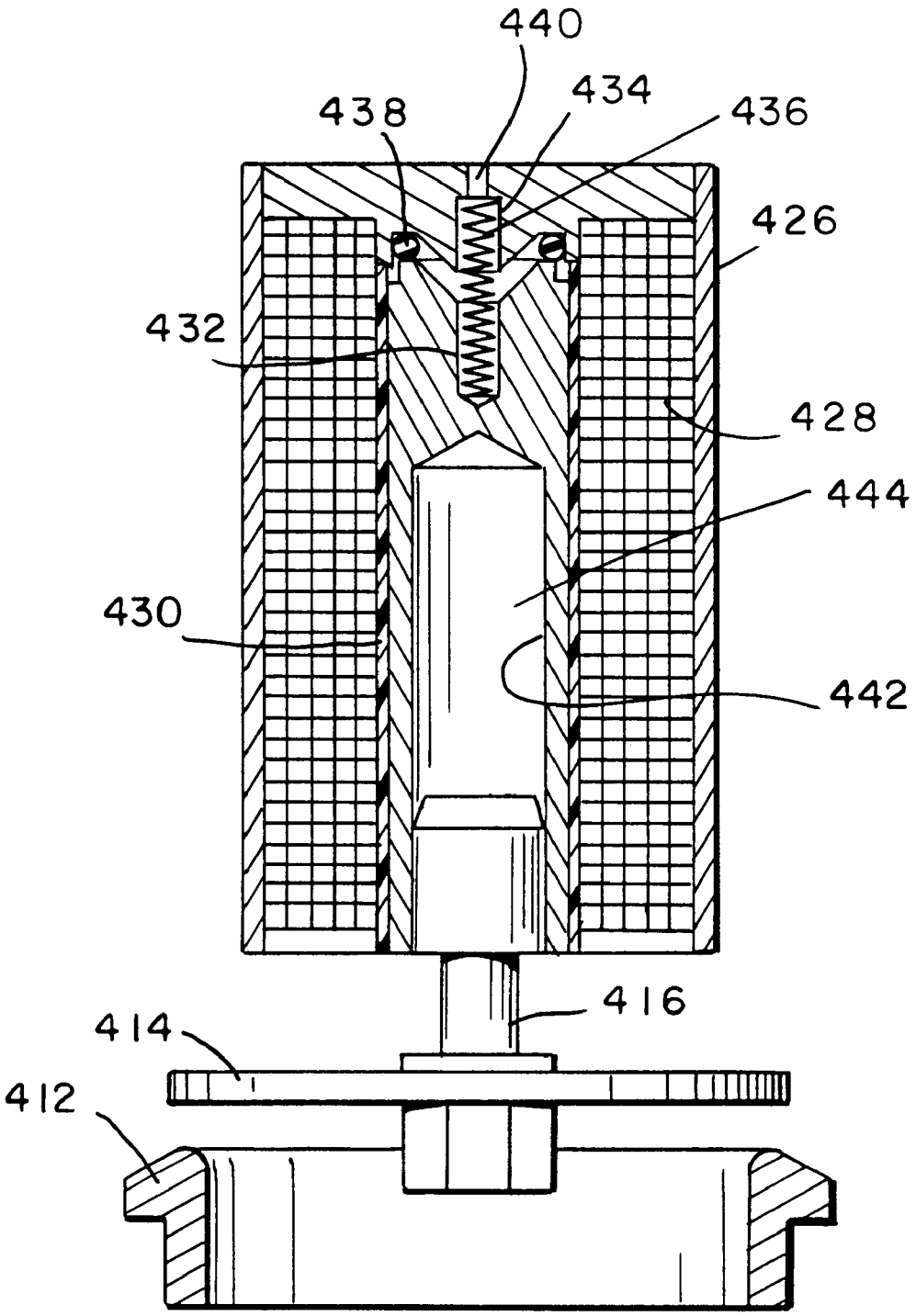
FIG. 9 is a cross-sectional view of a solenoid incorporating the principles of the present invention.

Details of the solenoid are shown in FIG. 9. The solenoids include a casing 426 and a coil 428 in which the core 444 rides. The plunger 416 is press fit in a bore 442 with a magnetic core 444. A nylon sleeve or bearing 430 separates the core 444 from the coil 428. Because of the high frequency of operation, the standard brass sleeve or bushing is not used. Spring 436 rests in a bore 432 in core 444 and bore 434 in the top wall of the casing 426. An O-ring 438 acts as a stop/shock absorber between the top wall of the casing 426 and the core 444. An opening 440 is provided in the top wall exposing the cavity between the top of the core 444 and the bottom of the top wall of the casing 426. It has been found that this vent is needed to prevent pressure/vacuum locking of the plunger. This substantially increases the speed or frequency capability of the solenoid.

Figure 7:
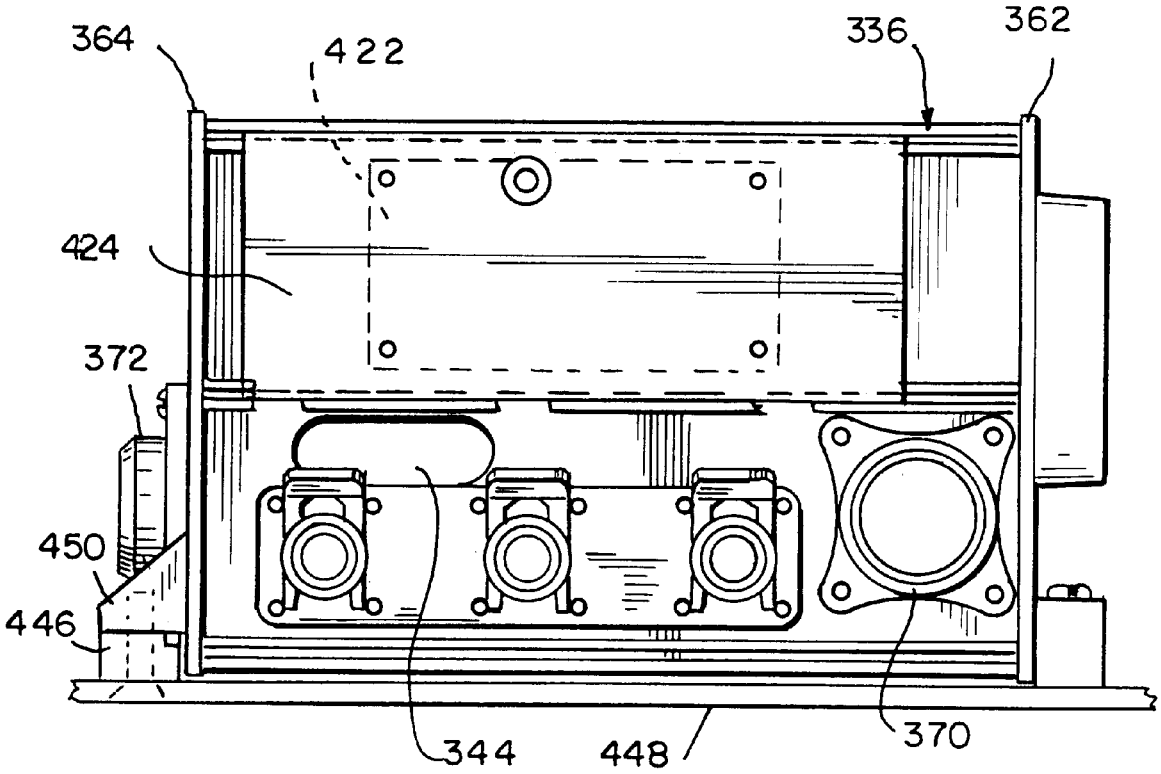
FIG. 7 is a side view of the assembly pulsating valve of FIG. 6.

As illustrated in FIG. 7, the exterior housing is mounted by a vibration dampening mount 446 to a surface 448 through extensions 450 of end walls 363 and 364.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A control of an air mattress comprising:

a housing having a supply chamber, an exhaust chamber, and a plenum; at least one supply port, one exhaust port and one outlet port on the housing and connected to the respective supply and exhaust chambers and the plenum;

a supply valve and an exhaust valve in the housing and connecting respectively the supply and exhaust chambers to the plenum; and a supply and an exhaust solenoid connected to the supply and exhaust valves respectively; the solenoids including a core in a casing and the valves being connected to a first end of the core through a first aperture in the casing; and further comprising a resilient stop and spring between the casing and a second end of the core, the resilient stop and spring abutting the core.

2. A control according to claim 1, wherein the housing includes an exterior housing and a separate interior housing; and the valves are in and the solenoids are mounted to the interior housing and covered by the exterior housing.

3. A control according to claim 2, wherein the interior housing defines the chambers within the exterior housing.

4. A control according to claim 2, wherein the ports are on the exterior housing.

5. A control according to claim 2, wherein the interior housing is a metal block forming a heat sink for the solenoids.

6. A control according to claim 1, including at least one supply outlet connected to the supply chamber.

7. A control according to claim 1, wherein the core is hollow substantially along its length.

8. A control according to claim 2, including a resilient element between the solenoid and the interior housing.

9. The valve of claim 1, wherein the chamber includes a plurality of ports.

10. The patient support of claim 1, further comprising a controller coupled to the supply and exhaust valves, the controller being configured to control movement of the supply and exhaust valves to produce one of percussion and vibration air pressure pulses.

11. A control of an air mattress comprising:

a housing having a supply chamber, an exhaust chamber, and a plenum; and at least one supply port, one exhaust port and one outlet port on the housing and connected to the respective supply and exhaust chambers and the plenum;

a supply valve and an exhaust valve in the housing and connecting respectively the supply and exhaust chambers to the plenum;

a supply and an exhaust solenoid connected to the supply and exhaust valves respectively; and a vibration dampening mount connected to the housing.

12. The valve of claim 11, further comprising a solenoid coupled to the supply valve.

13. The valve of claim 11, further comprising a solenoid coupled to the exhaust valve.

14. The valve of claim 11, further comprising a first solenoid coupled to the supply valve and a second solenoid coupled to the exhaust valve.

15. The valve of claim 11, wherein the plenum includes a plurality of ports.

16. The patient support of claim 11, further comprising a controller coupled to the supply and exhaust valves, the controller being configured to control movement of the supply and exhaust valves to produce one of percussion and vibration air pressure pulses.

17. The patient support of claim 15, further comprising an exterior housing and an interior housing, the plurality of ports of the plenum being on the exterior housing.

18. A valve for an air mattress, the valve comprising:

an inlet, a first valve in communication with the inlet, a second valve, a chamber in communication with the first and second valves, the chamber including an outlet, a controller coupled to the first and second valves, the controller being configured to control movement of the first and second valves to produce one of percussion and vibration air pressure pulses, and a vibration dampening mount.

19. The valve of claim 18, wherein the chamber includes a plurality of ports.

20. The patient support of claim 19, further comprising an exterior housing and an interior housing, the plurality of ports of the chamber being on the exterior housing.

21. A valve for an air mattress, the valve comprising:

an inlet, a first valve in communication with the inlet, a second valve, a chamber in communication with the first and second valves, the chamber including an outlet, a controller coupled to the first and second valves, the controller being configured to control movement of the first and second valves to produce one of percussion and vibration air pressure pulses, and a solenoid coupled to one of the first and second valves, the solenoid including a casing and a core, the core being coupled to the one of the first and second valves coupled to the solenoid, and the solenoid further comprising a resilient stop and spring abutting the core.

22. The valve of claim 21, wherein the chamber includes a plurality of ports.

23. The patient support of claim 22, further comprising an exterior housing and an interior housing, the plurality of ports of the chamber being on the exterior housing.

24. A patient support having a longitudinal axis, the patient support comprising:

a plurality of bladders, a first valve having a first valve inlet and a first valve outlet, a second valve having a second valve inlet and a second valve outlet, a chamber including a plurality of ports, each of the plurality of ports being coupled to one of the plurality of bladders, the chamber defining the first valve outlet and the second valve inlet, and a vibration dampening mount.

25. The patient support of claim 24, further comprising a solenoid coupled to the first valve.

26. The patient support of claim 24, further comprising a solenoid coupled to the second valve.

27. The patient support of claim 24, further comprising a first solenoid coupled to the first valve and a second solenoid coupled to the second valve.

28. The patient support of claim 24, further comprising an exterior housing and an interior housing, the plurality of ports of the chamber being on the exterior housing.

29. A patient support having a longitudinal axis, the patient support comprising:

a plurality of bladders, a first valve having a first valve inlet and a first valve outlet, a second valve having a second valve inlet and a second valve outlet, a chamber including a plurality of ports, each of the plurality of ports being coupled to one of the plurality of bladders, the chamber defining the first valve outlet and the second valve inlet, and a solenoid coupled to one of the first and second valves, the solenoid including a casing and a core, the core being coupled to the one of the first and second valves coupled to the solenoid, and the solenoid further comprising a resilient stop and spring abutting the core.

30. The patient support of claim 29, further comprising a controller coupled to the first and second valves, the controller being configured to control movement of the first and second valves to produce one of percussion and vibration air pressure pulses.

31. The patient support of claim 29, further comprising an exterior housing and an interior housing, the plurality of ports of the chamber being on the exterior housing.

32. The patient support of claim 31, wherein the first and second valves are positioned in the interior housing.

* * * * *